US010005307B2

(12) United States Patent
Langos et al.

(10) Patent No.: US 10,005,307 B2
(45) Date of Patent: Jun. 26, 2018

(54) REMOVABLE COVERING PAINT SCHEME OF LAYERS ARRANGED ON A HEAT-SENSITIVE CARRIER, THERMAL PRINTER, AND METHOD FOR THERMAL PRINTING SUCH A CARRIER

(71) Applicants: JKM Pronat Kft., Budapest (HU); Szegedi Tudomanyegyetem, Szeged (HU); Gyula Langos, Paszto (HU)

(72) Inventors: Gyula Langos, Paszto (HU); Janosne Kocsardi, Nagykovacsi (HU); Laszlo Juhasz, Budapest (HU); Peter Juhasz, Budapest (HU); Peter Kos, Budapest (HU); Zoltan Konya, Tiszasziget (HU); Akos Kukovecz, Domaszek (HU)

( * ) Notice: Subject to any disclaimer, the term of this patent is extended or adjusted under 35 U.S.C. 154(b) by 5 days.

(21) Appl. No.: 14/421,786

(22) PCT Filed: Sep. 3, 2014

(86) PCT No.: PCT/HU2014/000080
§ 371 (c)(1),
(2) Date: Feb. 13, 2015

(87) PCT Pub. No.: WO2015/033176
PCT Pub. Date: Mar. 12, 2015

(65) Prior Publication Data

US 2016/0279995 A1 Sep. 29, 2016

(30) Foreign Application Priority Data

Sep. 3, 2013 (HU) ..... 1300511

(51) Int. Cl.
*B41M 5/42* (2006.01)
*B41M 5/44* (2006.01)
(Continued)

(52) U.S. Cl.
CPC ..... *B41M 5/44* (2013.01); *A63F 3/0665* (2013.01); *B41J 2/32* (2013.01); *B41J 11/0015* (2013.01);
(Continued)

(58) Field of Classification Search
CPC ..... B41M 3/00; B41M 3/005; B41M 5/42; B41M 5/426; B41M 5/44; B41M 5/443;
(Continued)

(56) References Cited

FOREIGN PATENT DOCUMENTS

WO 2007//032900 * 3/2007 ..... B65C 9/46

OTHER PUBLICATIONS

International Search Report in PCT/HU2014/000080 dated May 27, 2015.

* cited by examiner

*Primary Examiner* — Bruce H Hess
(74) *Attorney, Agent, or Firm* — Dowell & Dowell, P.C.

(57) ABSTRACT

This invention relates to a removable multilayered aqueous flexo covering paint scheme of layers arranged on a heat sensitive carrier (1) provided by a heat sensitive layer (2) to be colored by applying heat, and a coat of lacquer (3) containing 70% acrylate oligomer, 22% acrylate monomer, 5% photo-initiator and 3% silicone is arranged on the heat sensitive layer (2); a disperse parting layer (4) containing 20-35% soot paste, 25% aqueous acrylate emulsion, 6% calcined kaolin, 1% antifoam agent and spread improver, 3% c rheological modifier and 45% water is arranged on the coat of lacquer (3); and a covering paint layer (5) containing carbon nanotubes functionalized by hydroxyl, carbonyl and carboxy groups is arranged on the disperse parting layer (4). A method and apparatus for thermal printing of a carrier (1) preprinted by the removable multilayered aqueous flexo covering paint scheme of layers and provided by a heat
(Continued)

Figure 1:
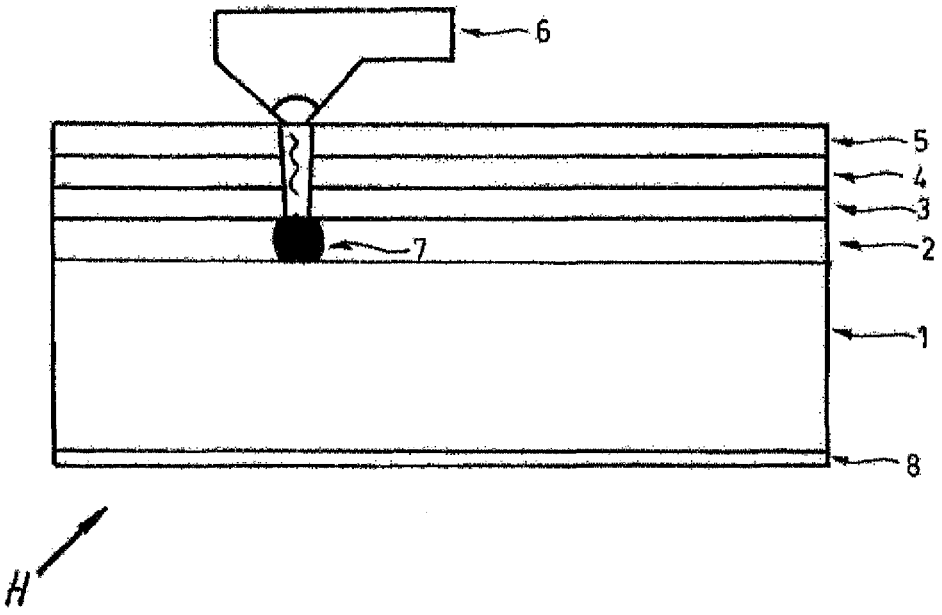

sensitive layer (2) to be colored by applying heat is also disclosed.

6 Claims, 10 Drawing Sheets

(51) Int. Cl.

| | |
|---|---|
| ***A63F 3/06*** | (2006.01) |
| ***B41M 3/00*** | (2006.01) |
| ***B41J 11/00*** | (2006.01) |
| ***B41J 2/32*** | (2006.01) |

(52) U.S. Cl.
CPC ..... *B41M 3/005* (2013.01); *B41M 5/42* (2013.01); *B41M 5/426* (2013.01); *B41M 5/443* (2013.01); *B41M 2205/04* (2013.01); *B41M 2205/38* (2013.01); *B41M 2205/40* (2013.01)

(58) Field of Classification Search
CPC ..... B41M 2205/04; B41M 2205/38; B41M 2205/40
USPC ..... 503/200–226
See application file for complete search history.

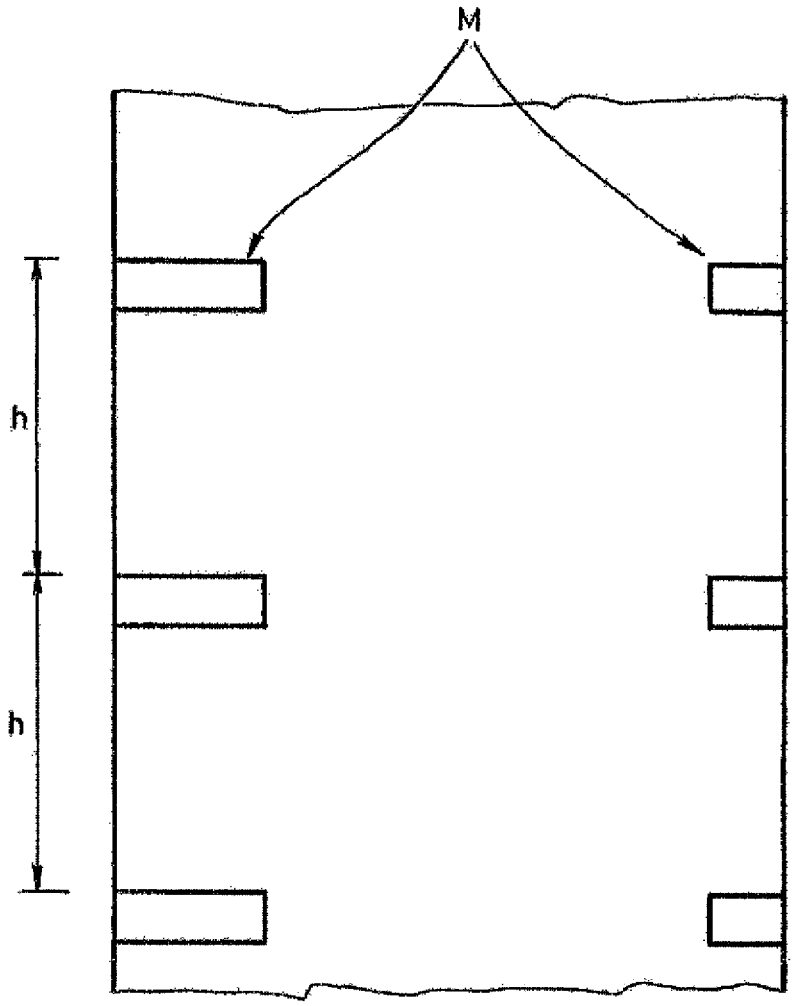
*Fig.* 10.

REMOVABLE COVERING PAINT SCHEME OF LAYERS ARRANGED ON A HEAT-SENSITIVE CARRIER, THERMAL PRINTER, AND METHOD FOR THERMAL PRINTING SUCH A CARRIER

This invention relates to a removable aqueous flexo covering paint scheme of layers, or flexografic topcoat system of layers, arranged on a heat sensitive carrier provided by a heat sensitive layer to be colored by applying heat, and an apparatus for thermal printing of a heat sensitive carrier provided by a heat sensitive layer to be colored by applying heat and preprinted by a removable aqueous flexo covering paint scheme of layers, and a method for thermal printing of a heat sensitive carrier provided by a heat sensitive layer to be colored by applying heat and preprinted by a removable aqueous flexo covering paint scheme of layers.

Thermal printers generally print on a substrate provided by a heat-sensitive layer discolouring by affection of heat, for example on paper, inter alia on papers, for which the heat transfer between the printing head and the heat-sensitive layer, is provided by a e.g. aqueous multilayered flexo paint scheme arranged on the paper sheet in several layers, resulting at the same time in making the finished print invisible for unauthorized persons, that is its coverage.

The thicker and more complex the paint scheme arranged on the heat-sensitive layer, the more weakened its yet originally weak thermal conductivity. However, to develop an elementary impression, e.g. a point, of adequate quality a suitable and concentrated heat power is necessary to reach the surface of the heat-sensitive layer disposed between the substrate and the paint layer. An adequate thermal performance to be imposed the on heat-sensitive layer can be achieved e.g. by increasing the heating power of the printing head, however, this solution has the disadvantage that, on the one hand, the thermal power consumption of the thermal printer increases, which increases the cost of printing, reduces its efficiency, and on the other hand increasing of thermal radiation intensity emitted by the thermal head increases diffusivity, which is clearly detrimental to both the contour lines of the print and the degree of discoloration or gradation. Thus, this solution should not be used in such an IT system where the print is not adjustable individually, and a static or self-adjusting printing process is a basic requirement.

Since there is a correlation between moisture content and thermal conductivity of the topcoat layer scheme covering the thermosensitive layer applied on the carrier or substrate, for example paper, another way to achieve an adequate heating effect imposed on the heat-sensitive layer is that adjusting the collective moisture content of the layer scheme covering the thermosensitive layer applied on the carrier or substrate, for example paper and the paper itself, in such a way that the collective moisture content of the paper and the layer scheme covering the thermosensitive layer applied on the paper should be optimal for the formation of the print.

Published document U.S. Pat. No. 5,552,818 discloses a method of making heat-print on a heat-sensitive substrate by means of heat radiation directed to the substrate, in which the moisture content of the substrate is regulated during the printing. This control is carried out by local heat radiation less intense than the printing heat, which causes a portion of the moisture content of the substrate to evaporate, so that the moisture content and thus also the thermal conductivity of the heat-sensitive substrate can be reduced to a desired extent, that is to an optimum value. In a preferred embodiment the moisture content of the immediate environment is also taking into account during heat treatment.

The main drawback of this solution is that it is suitable only for reducing the moisture content of the heat sensitive carrier-paint layer scheme, thus a preprint moisture content of the heat sensitive carrier-paint layer scheme must exceed a value corresponding to optimal heat conductivity, which should be established by pre-humidification of the scheme. A further disadvantage is that the radiation intensity of both the printing heat radiation and that of heat radiation having lower intensity applied for control the moisture content are relatively high, otherwise the heat-sensitive substrate-ink layer scheme would not be affected by effective radiation, since thermal conductivity of the paint system—usually water based flexo paint—applied onto the heat-sensitive substrate is weak, it is actually insulating. However, by increasing the radiation energy a thermal deformation of the ink layer system may occur so that the energy of the radiation does not exceed a certain threshold value being characteristic to the paint layer system.

At the same time, increasing the heat conductivity of ink layer scheme applied on the heat-sensitive substrate, while reducing the required intensity of radiation, would have energy savings and improvement in print quality by avoiding thermal deformation of the paint layer system.

As the acrylate resin base material of the water-based paint systems has a very good heat insulation property, it is desirable, while printing heat-sensitive surface of the thermal paper, to minimize the heat loss across the layer printed with cover ink. This requirement is a fundamental one for the covered, encrypted carriers, wherein the combined thickness of paint layers printed on the heat-sensitive layer of the carrier—e.g. paper—before the thermal printing may be even 5-8 microns unlike traditional 1-3 microns of thickness of a paint layer. This is the case mainly with multilayer scratch-off paint systems used on lottery tickets, where the final heatprint is covered by previously applied thermal and auxiliary mask layers. However, a thick paint layer system has to transmit the heat sufficient to heat printing despite its thickness, in order to achieve an appropriate quality of print.

The applicant has found that a sufficient thermal conductivity of a thick paint layer can be achieved by applying single or multi-walled nanotubes e.g. carbon nanotubes in the paint system. This way a heat loss no more than 10% occurs in the heat transmitted through a paint layer having a thickness even 5-8 microns in contrast with the traditionally applied 1-3 microns thick paint layer for flexo printing.

The low electric conductivity of thermo paper and the resin base paint is significantly increased as well when mixing carbon nanotubes with the paint. Main heat transfer elements of the paint according to the invention are properly functionalized, multi-walled carbon nanotubes having adequate length and embedded in crosslinked resin. According to a correlation experienced as a new one by the applicant while testing flexo inks containing multi-walled carbon nanotubes, for a flexo ink containing carbon nanotubes applied directly to a heat sensitive carrier—e.g. a paper sheet provided by a heat sensitive layer—the electric and consequently also heat conductivity of the system consisting of heat-sensitive substrate and flexo ink containing carbon nanotubes vary depending on relative humidity and temperature of the ambient air. Therefore it is necessary to control also the combined moisture content of the ink layer containing carbon nanotubes applied on heat-sensitive substrate in order to ensure its optimum thermal conductivity at the time of printing.

Therefore, the object of the invention is to provide on the one hand a heat transmitting covering paint scheme having improved heat transmitting properties and arranged on a heat sensitive carrier, e.g. on a paper strip or sheet or web provided with a heat sensitive layer discolouring by heat, which is removable without damaging the heat sensitive layer, but its heat conductivity and, therefore, the quality of a print to be formed there under are far better than that of removable topcoat ink layers belonging to the state of the art. On the other hand a further objective is to provide a thermal printer and thermal printing process, by which the thermal conductivity of a topcoat ink system with improved thermal conductivity according to the present invention can be optimized directly during printing without the coated carrier would have a pre-printing moisture content necessarily exceeding the optimum moisture content, immediately before printing. Therefore, the heat energy level required to form the print may be lower resulting in reduced power consumption and the thermal deformation of the topcoat layer system can be avoided as well.

Above aims are achieved by providing a removable aqueous flexo covering paint scheme of layers arranged on a heat sensitive carrier provided by a heat sensitive layer to be colored by applying heat, and a coat of lacquer containing 70% acrylate oligomer, 22% acrylate monomer, 5% photo-initiator and 3% silicone is arranged on the heat sensitive layer; a disperse parting layer containing 20% soot paste with 35% of soot, 25% aqueous acrylate emulsion, 6% calcined kaolin, 1% antifoam agent and spread improver, 3% rheological modifier and 45% water is arranged on the coat of lacquer; and a topcoat paint layer containing carbon nanotubes functionalized by hydroxyl, carbonyl and carboxy groups is arranged on the disperse parting layer.

The length of the carbon nanotubes arranged in the topcoat layer is advantageously between 4-20 microns.

The topcoat layer is formed by 32% of an aluminum paste containing 70% Al, 3% nanotube paste, 60% aqueous acrylate emulsion, 1% antifoam agent and spread improver, and 4% of water.

The carbon nanotube paste consists of 5% hydrophilized carbon nanotubes having a length of 4-20 microns, 20% aqueous acrylate emulsion, and 2% of an antifoaming and spread improver agent, 0.3% pH adjusting additive, 0.2% biocide additive, 3% isopropyl alcohol, and 69.5% of water.

An apparatus for thermal printing of a heat sensitive carrier provided by a heat sensitive layer (2) to be colored by applying heat and preprinted by a removable aqueous flexo covering paint scheme of layers is also provided by the invention, which comprises a housing provided by a reel adapted for storing and dispensing said carrier; a transfer and counterpressure roller; and a thermal printing head, and the apparatus further comprising a measuring element for measuring electric resistance of a measuring field; a measuring table; an air blower system capable of adjusting the air temperature prevailing inside the housing; a sensor for detecting actual position of the measuring field and for determining the operation of the measuring element; a reservoir containing air of 0% relative humidity and provided by an air nozzle; an evaporative heating element; a reservoir containing water and connected to a fluid atomizing nozzle; and an electronic control means for controlling the operation of the nozzles of the reservoirs, the air blower system as well as said heating element, according to a value of electric resistance measured by the measuring element.

The measuring element measuring the electric resistance of said measuring field comprises at least two electrodes provided by an insulating edge.

The electrode consists of a silver-plated copper block having an air duct formed thereinside, which is connected to a vacuum space and led onto a contact surface of the copper block.

The reservoir containing air with 0% RH relative humidity consists of a tank heated by electric resistance means.

A chamber filled with hydroscopic mineral is connected to the reservoir containing air with 0% RH relative humidity.

Moreover, a method for thermal printing of a heat sensitive carrier provided by a heat sensitive layer to be colored by applying heat and preprinted by a removable aqueous flexo covering paint scheme of layers is also elaborated, which method comprises the steps of subjecting the heat-sensitive layer of the carrier to heat radiation generated by a thermal printing head, and before applying said thermal radiation, a measuring field being formed on the heat-sensitive layer of the carrier (1); determining experimentally a function Fr between the electric resistance and temperature as well as relative humidity of environment of the flexo covering paint scheme of layers; then determining a value of relative humidity RHM belonging to a maximum of a function Fs between thermal conductivity and temperature as well as relative humidity of environment of the flexo covering paint scheme of layers; measuring electric resistance of the measuring field; determining relative humidity of the measuring field by using the value of the resistance and the function Fr; and changing the value of relative humidity into the value of relative humidity RHM in a space directly surrounding the carrier.

A measuring field is formed on the heat-sensitive layer of the carrier, consisting disperse parting layer containing 20% soot paste with 35% of soot, 25% aqueous acrylate emulsion, 6% calcined kaolin, 1% antifoam agent and spread improver, 3% rheological modifier and 45% water, and a topcoat paint layer containing carbon nanotubes functionalized by hydroxyl, carbonyl and carboxy groups arranged on the disperse parting layer.

Figure 2:
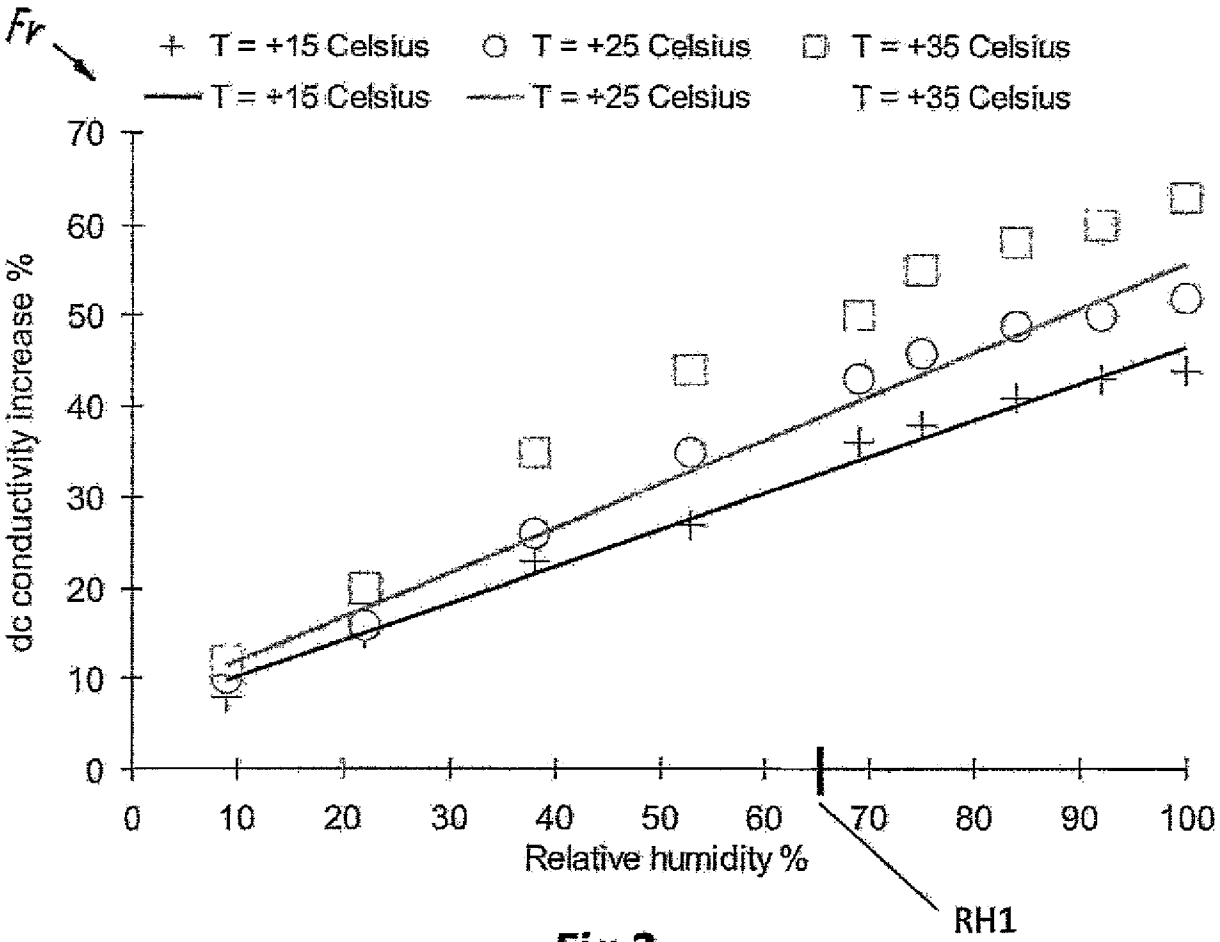
Figure 3:
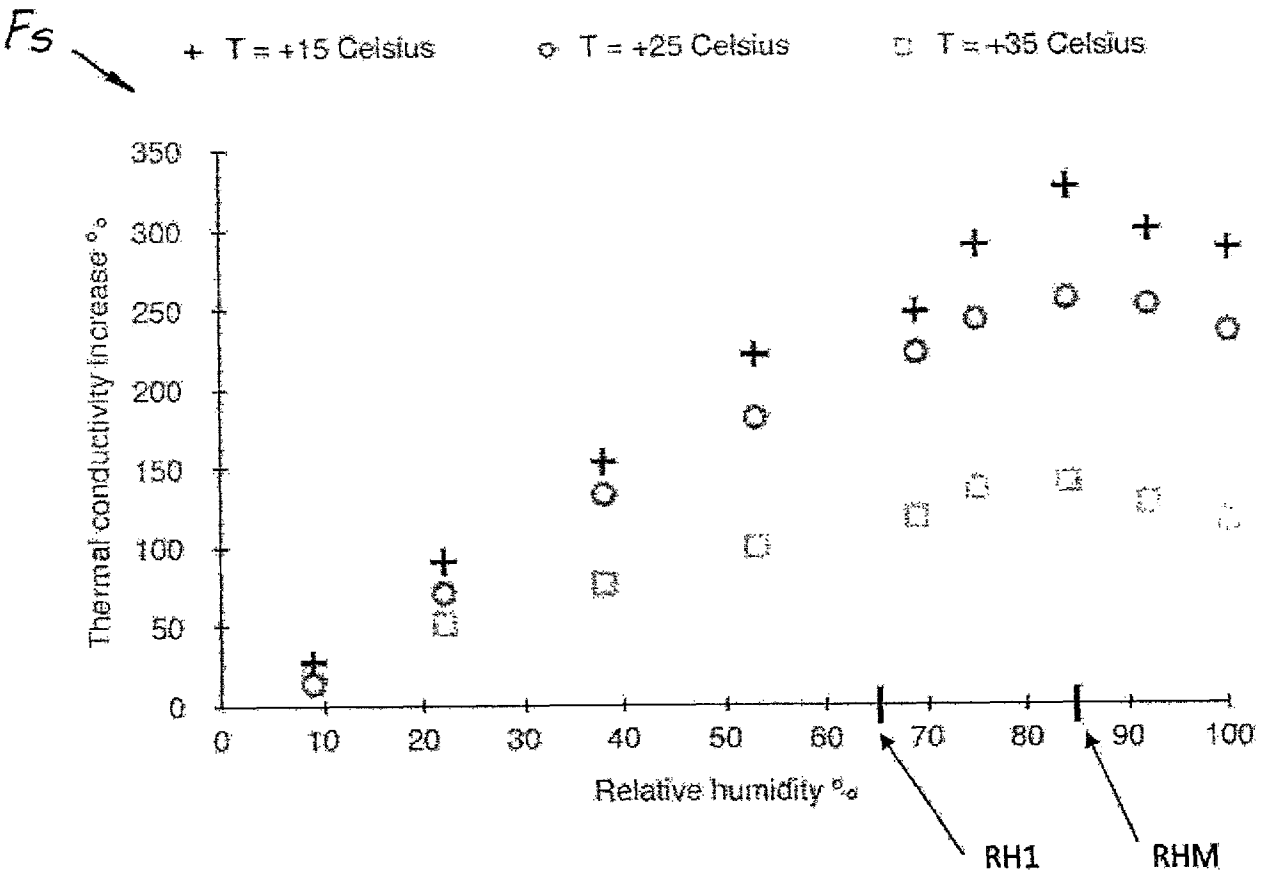
Figure 4:
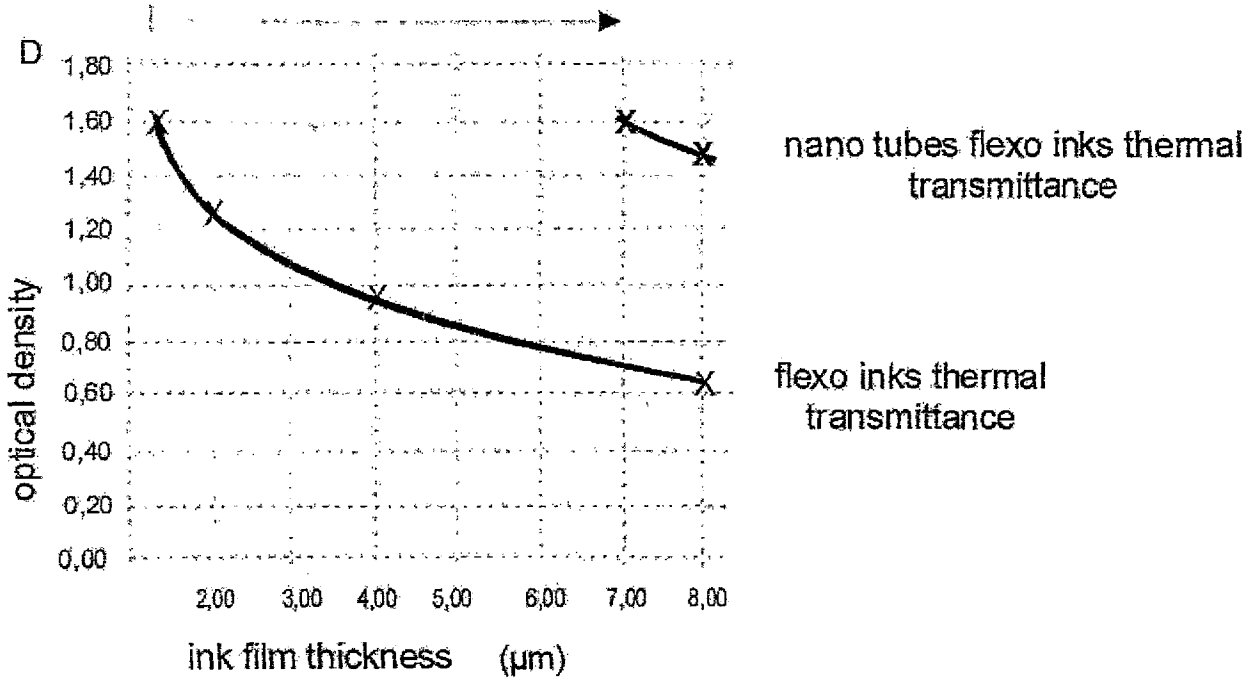
Figure 5:
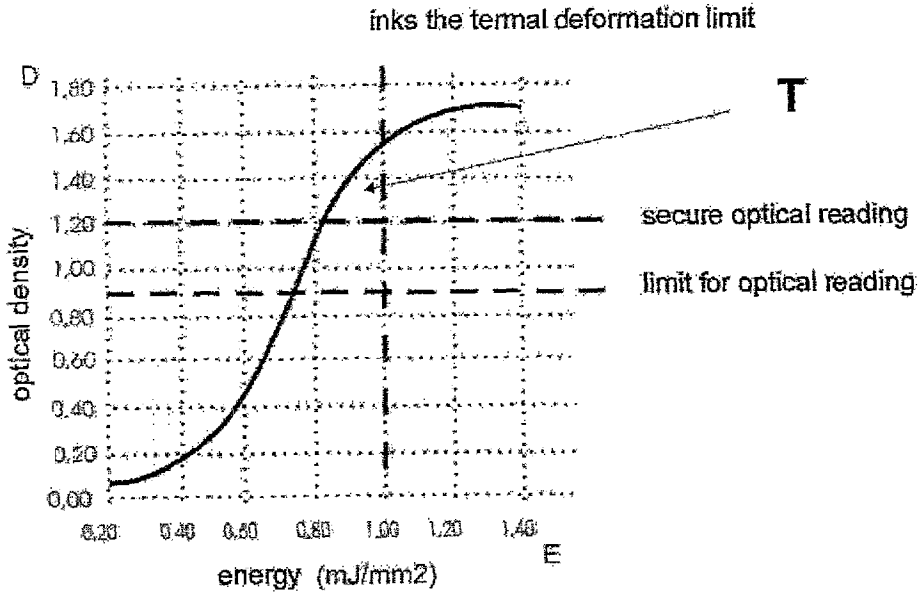
Figure 6:
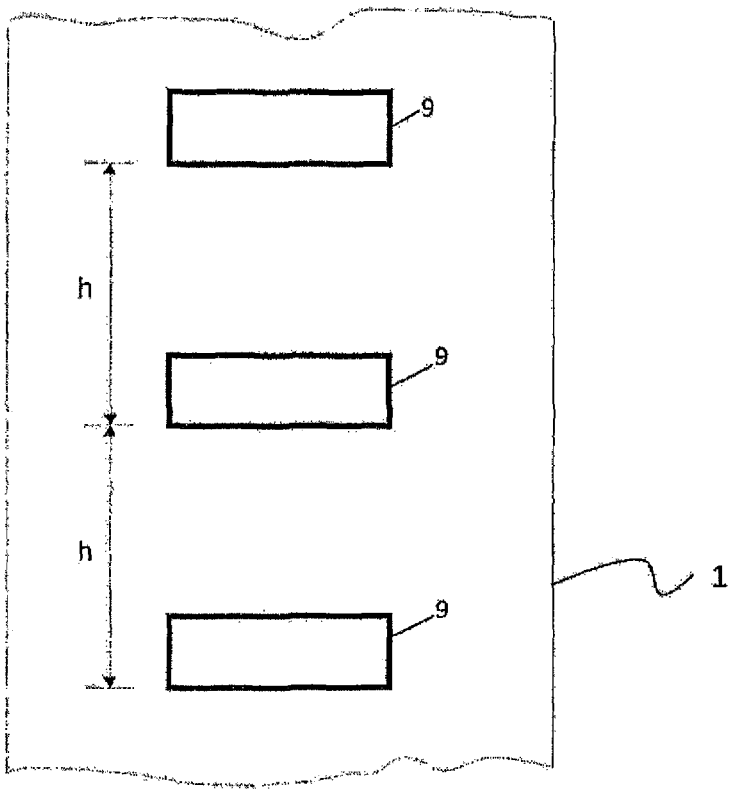
Figure 7:
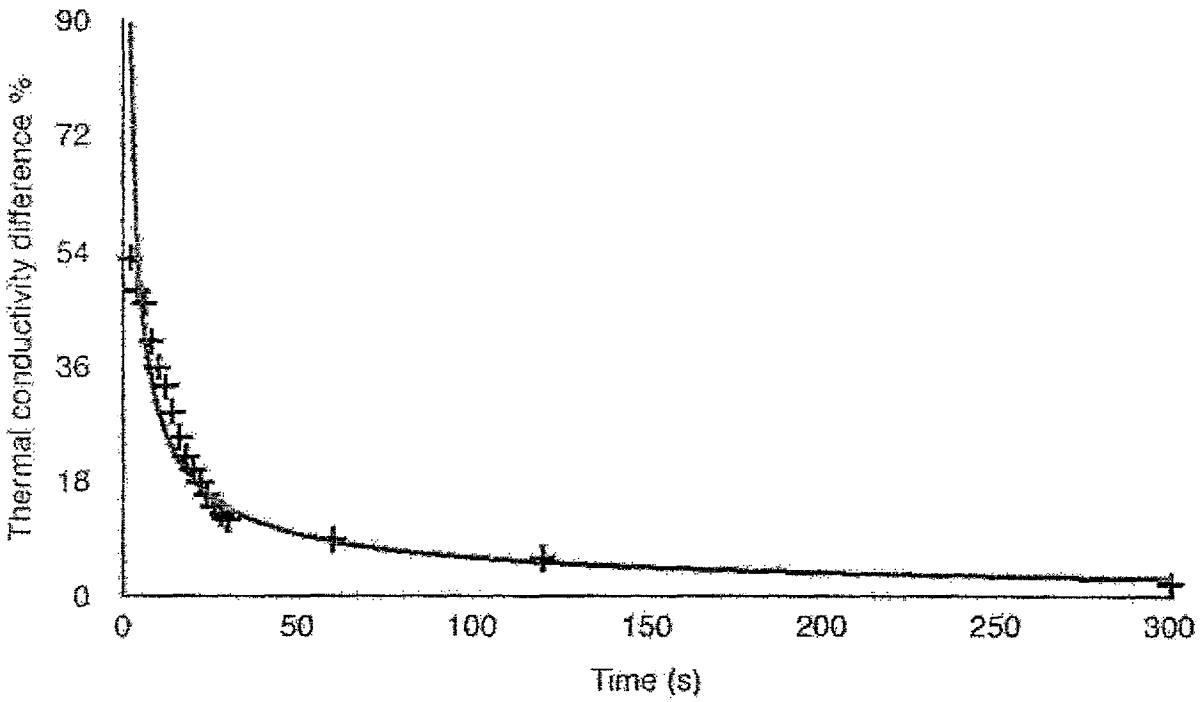
Figure 8:
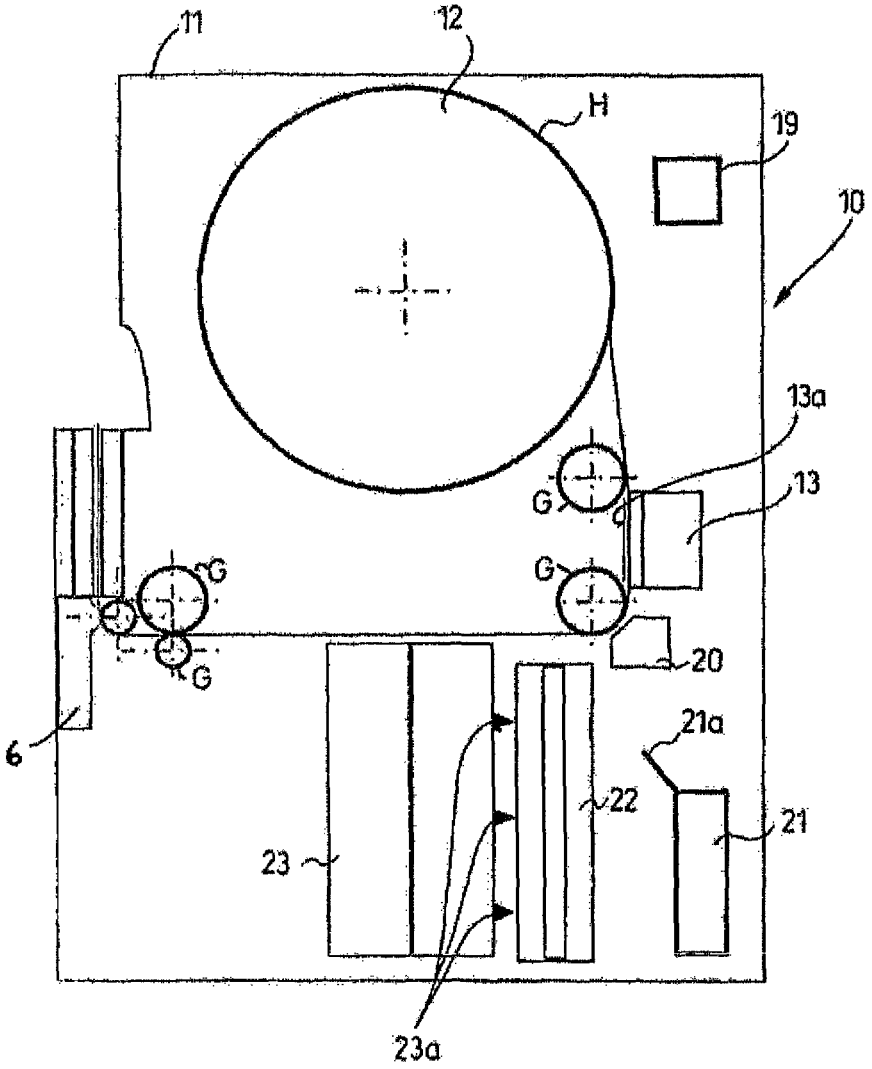
Figure 9:
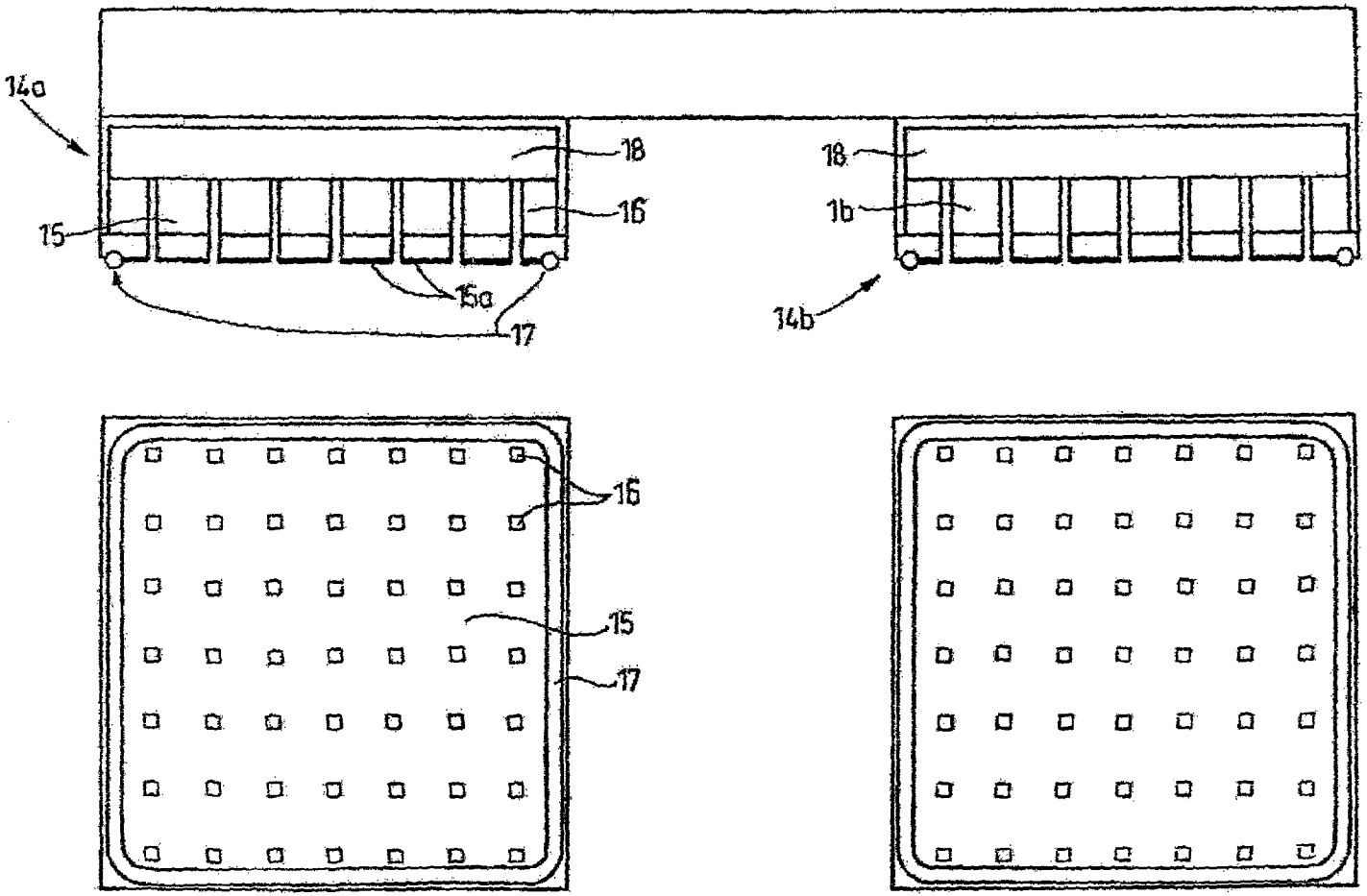

The invention will be described in detail with reference to the accompanying drawings. In the drawings:

FIG. 1 shows the structure of a removable aqueous flexographic—or flexo—covering paint scheme of layers with improved thermal conductivity, according to the invention, in FIG. 2 the change of combined electric conductivity of the flexographic covering paint scheme of layers containing carbon nanotubes according to the invention and a thermal paper is shown as a function of relative humidity, in FIG. 3 the change of combined heat conductivity of the flexographic covering paint scheme of layers containing carbon nanotubes according to the invention and a thermal paper is shown as a function of relative humidity of the environment, in FIG. 4 variation of optical blackening (gradation or density) of thermo paper provided by flexographic covering paint scheme of layers containing carbon nanotubes and conventional topcoat layer, respectively, is shown as a function of the thickness of layer scheme, in FIG. 5 blackening (gradation or density) of the thermal paper provided by flexographic covering paint scheme of layers containing carbon nanotubes is shown as a function of energy imparted, where we can observe that the area delimited by the boundary of thermal deformation of covering paint scheme of layers and by the level of secure optical reading is rather narrow (0.2 $mJ/mm^2$), the FIG. 6 shows a measuring field arranged on the carrier as necessary, on which a vacuum measuring element carries out the measurements, in FIG. 7 the thermal conductivity of a thermal paper sample provided by flexographic covering paint scheme of layers containing carbon nanotubes and placed at an environment of 25° C./85% RH relative humidity as removed from exsiccator is shown as a function of time, the FIG. 8 is a schematic representation of the thermal printer according to the invention, the FIG. 9 shows the configuration of the measuring element, and FIG. 10 shows photocell signs formed on the back of the carrier according to the position of the measuring field.

In FIG. 1 the structure of an aqueous flexographic—or flexo—covering paint scheme of layers with adequate thermal conductivity according to the invention is shown. For the sake of clarity, this figure also depicts a printing head 6 of a thermal printer device 10 according to the invention, which will be described later in detail. As shown in FIG. 1, on a carrier 1 of a thermal paper H, for example a sheet or tape of paper, etc., a heat-sensitive layer 2 to be discolored by heat, and known per se in the art, is arranged. It can also be shown in the Figure, that a layer 3 or coat of lacquer, which comprises of 70% acrylate oligomer, 22% acrylate monomer, a photoinitiator mixture of 5% and silicone additives of 3% made by mixing with simple slow stirring is arranged on the heat-sensitive layer 2. On the coat of lacquer 3 a parting layer 4 is arranged, which is a mixture of 20% soot paste with 35% soot, 25% aqueous acrylate emulsions, calcined kaolin 6%, 1% antifoaming agent and spread improver, 3% rheological modifier, and 45% water, which is made by dispersing these constituents in a dispersing device with 1000 revolutions/minute for 30 minutes in order to achieve a proper colloidal state.

The heat-sensitive layer 2 is to be discolored by the effect of the thermal radiation of a thermal printing head 6 to form a visible change 7 of appropriate value of density, that is to be darkened in radiation range of heat penetrating the layer 2. If the visible change 7 should be temporarily hidden, as it is a requirement in the case of scratch-off lottery tickets, a finish coat having adequate thermal conductivity should be arranged, preferably printed, on the top of the heat sensitive layer 2, that makes the otherwise visible change 7 invisible to unauthorized persons for. However, due to the closed surface structure of the heat-sensitive layer 2 of the carrier 1 it is difficult to be printed. Even if it is printable by a given ink, the print usually cannot be removed without any damage of the heat-sensitive layer 2. A complex requirement of having printability and removability for example by scratch-off at the same time requires several layers of paint to be applied, but the paint layers should not form a strong surface bond with each other. Nevertheless, the more the number of layers of paint, the lower the thermal conductivity of the layer scheme, which adversely affects the safe readability of the thermal print.

Therefore, to improve the thermal conductivity of the paint scheme the applicant have developed a thermally conductive, water-based polar solvent flexographic ink according to the invention for thermal papers H, which can be scratched off without any damage of the thermal print, and in which a channel system improving heat conductivity by using multi-walled carbon nanotubes are applied.

Both single-walled and multi-walled carbon nanotubes are extraordinally good conductors of heat, their coefficient of thermal conductivity falls in a range from hundreds to thousands W/mK depending on a degree of purity and the number of their defects. This value is greater by several orders of magnitude than the heat conductivity of polymer resins forming the raw material for paints, which is typically within 1 W/(mK) range. Currently, large-scale production (hundreds of tons/year) of single-walled carbon nanotubes is not running anywhere in the world, so to improve the thermal properties multi-walled carbon nanotubes are used according to the present invention.

Since the thickness of a scratch-off ink multilayer system is generally 2-8 microns, the length of carbon nanotubes used may be between 120 nm-500 microns, depending on the method of its production and after-treatment. Too short tubes do not form continuous thermal duct system in the ink matrix, but too long ones are oriented in the plane of the print in any case and therefore they are not suitable for conducting heat through the layers. We have experimentally determined the optimal length of the nanotubes in the flexo ink, the optimum of which falls between 4 and 20 microns.

The carbon nanotubes are essentially hydrophobic materials, but paints are polar types (water- or ethanol-based) and therefore nanotubes having even adequate length cannot be dispersed appropriately in a paint without some chemical modification. In this regard, hydroxyl, carbonyl and carboxy groups have been formed by oxidative functionalization on the nanotubes. We have checked on many ways of functionalization, and the following procedure has been found to be optimal:

providing 5 g of carbon nanotubes in 500 $cm^3$ of HNO3 solution of 65% concentration, the mixture was boiled reflowing on 300° C. for 6 hours, the system was allowed to cool to room temperature in 12 hours in unfiltered state, washed to neutral pH with distilled water, dried in an air drying box on 80° C. for 4 hours.

As regards the use in a topcoat paint layer 5 it is a critical step to crush the material in a mortar in every 30 minutes during drying. If this step is not done the resulting material can not be sufficiently dispersed into the flexo ink. Laboratory experiments have shown that a paint having a nanotube content of 2-5% cannot be printed directly because of its very high viscosity, thus making the nanotube not directly applicable to make a printing paint. Therefore, a nanotube paste containing 5% of nanotubes was prepared. Measurements made by both the laboratory and industrial scale test prints demonstrated that the nanotube content imparts exceptionally good thermal and electric conductivity to the paint. As regards size compatibility, as mentioned above, application of nanotubes having a size of approx. 4-20 microns is advantageous, from which a paste containing 5% nanotubes may be prepared by bead-grinder, and then can be mixed into a polar type aqueous paint system. According to our analyzes the nanotubes in the internal structure of the ink matrix are located perpendicularly to the plane of the carrier 1, e.g. paper sheet, owing to forces imparting to the matrix during printing, meshing some extent the paint film, and protruding from the top of the paint layer 5 to accept the heat energy to be conveyed.

Preparation of carbon nanotube paste takes place as follows: mixing 5% multi-wall hydrophilized carbon nanotube of 4-20 microns long, with 20% aqueous acrylic emulsion, and 2% antifoam spread improver, 0.3% pH adjustment agent, 0.2% biocide agent (antibacterial and anti-fungal), 3% isopropyl alcohol and 69.5% water and grinding in a bead-grinder for a period of one hour at a rate of 500 revolutions/minute with glass beads of 1 mm in diameter. Nanotube paste thus prepared is used for the preparation of the topcoat paint 5: 32% aluminum paste of 70% Al, 3% nanotube paste, 60% aqueous acrylic emulsion, and antifoam terülésjavító 1%, 4% water, by a simple slow agitation at 500 revolutions/minute.

On the surface of the carrier 1 opposite the heat-sensitive layer 2 a black perturbing print 8 hindering translucence may be formed, which is e.g. a 3 microns thick ink flexo print with standard high carbon black content.

Thermally conductive flexo ink provided by multi-walled carbon nanotubes according to the present invention increases thermal conductivity of the printed ink layer by magnitudes. By using thermally conductive flexo ink provided by multi-walled carbon nanotubes according to the present invention a water based, multilayered flexo ink scheme having appropriate heat conductivity and a layer order as seen e.g. in FIG. 1 can be constructed and printed onto a thermal paper H, which can be removed by scraping without any destruction of the heat-sensitive layer 2.

Layers 3, 4, 5 may be applied by flexo printing onto the heat sensitive layer 2 for forming the thermal paper H provided by an aqueous, multilayered topcoat flexo ink scheme, in such a way that the heat sensitive layer 2 of a roll of thermal paper H running with a speed of 0.85 m/s is overprinted by an UV light drying lacquer layer 3 having a thickness of 1 μm, which layer 3 is hardened sufficiently as exposed to an UV light source with 1.5 $kWh/m^2$ power after printing. Then, a disperse parting layer 4 having 1 μm thickness and a 6-8 μm thick, heat conductive topcoat layer 5 containing carbon nanotubes are printed thereon.

After testing at laboratory scale, the examination of the flexo ink layer 5 scheme containing multiwalled carbon nanotubes in aqueous matrix has been repeated at industrial conditions. Proof impressions made by a stud at laboratory scale with different layer thickness as well as machine printing has been prepared. For commensurating the dimensions of prints produced at laboratory scale with those at industrial conditions a determination of cell depth of the anilox roll has been calculated according to the expression 3 n+n/3, where 'n' is the dry layer thickness required. In FIG. 2 the change of combined electric conductivity of the flexografic topcoat system of layers containing carbon nanotubes according to the invention and a thermal paper H of standard topcoat quality is shown as a function of relative humidity. It can be observed in the Figure, that electric conductivity is directly proportional to the relative humidity. Since the moisture content or humidity of the air and the material of the thermal paper H provided by the topcoat layer system is in dynamic equilibrium, electric conductivity of the system and consequently its heat conductivity is also finely adjustable by altering the humidity of the whole system consisting of the paper+paint layers, that is by precisely controlling the relative humidity of the air in the microenvironment of printing.

Increase of the electric conductivity can be seen in the form of a percentage increase relating to the base electric conductivity of the paint+paper system fully dried and kept in an exsiccator having 0 RH % humidity inside. It can be discerned that the increase of the electric conductivity may be considered as being linear throughout the whole RH % scale in a range of ambient temperature expected at typical operational circumstances of thermal printing. An increase of the slope of characteristic curve depending on the ambient temperature is caused probably by a greater mobility of secunder carriers of charge.

In FIG. 3 the change of combined heat conductivity of the flexographic covering paint scheme of layers containing carbon nanotubes according to the invention and a thermal paper H is shown as a function of relative humidity of the environment. Increase of the heat conductivity can be seen in the form of a percentage increase relating to the base electric conductivity of the paint+paper system fully dried and kept in an exsiccator having 0 RH % humidity inside. The behavior of these curves differs from those seen in FIG. 2 in that the maximum of thermal conductivity can be found by 85 RH % rather than 100%. One possible reason of the curve characteristic with a maximum is that the absolute humidity of the paint+paper system increase as well along with the increase of the relative humidity of the air, which affects negatively the heat conductivity of the system at the greatest RH % values due to a high heat capacity of the water having the same time a heat conductivity weaker than that of carbon nanotubes. It has been found that the higher increase of percentage of heat conductivity in a range of ambient temperature expected at typical operational circumstances of thermal printing was achieved by systems kept in an atmosphere having a relative moisture content about 80-90 RH %, that is this range represents the optimum of relative humidity as regards the heat conductivity.

According to the correlations presented in FIGS. 2 and 3 it is clear that having adequate information about the electric conductivity and temperature of a complete system consisting of the topcoat paint system of layers arranged on a thermal paper H, the relative humidity and therefore the heat conductivity of this complete system can be determined. In FIG. 3 a maximum of heat conductivity of the system in a normal printing range of temperature between 15° C. and 35° C. can be observed. Consequently, the optimal heat conductivity of the flexo topcoat paint system of layers containing nanotubes provided on thermal paper H can be adjusted even in the moment of printing by means of a method according to the invention including changing its environmental humidity as follows.

Variation of optical blackening (gradation or density) of thermo paper provided by flexographic covering paint scheme of layers containing carbon nanotubes and conventional topcoat layer, respectively, is shown as a function of the thickness of layer scheme in FIG. 4.

We have found that the alteration ΔQ (decrease) of an amount of heat Q transmitted by a printing head 6 while transiting layers 5,4,3 for obtaining a change 7 having adequate density value in the layer 2 of the thermal paper H is not more than 10%, but in order to obtain less heat loss a further improvement of heat conductivity of the aqueous flexo topcoat print layers containing nanotubes would be required, which can be achieved by means of a heat printer according to the invention described later.

Density (or gradation) of the thermal paper H provided by flexographic covering paint scheme of layers containing carbon nanotubes is shown as a function of energy imparted, where one can observe that an area T delimited by the boundary of thermal deformation of covering paint scheme of layers and by the level of secure optical reading is explicitly narrow (0.2 $mJ/mm^2$) as it is seen in FIG. 5.

By using a method according to the invention a relative humidity RH accordant with the actual ambient temperature of thermal printing is determined by means of measuring fields 9 printed with an ink containing carbon nanotubes directly onto the surface of heat sensitive carrier 1 (that is omitting the lacquer layer 3), preferably spaced apart by moving units h, as it is seen in FIG. 6, the area of which is 10×30 mm in the embodiment depicted.

Measuring fields 9 are printed directly onto the thermal paper H, that is the lacquer layer 3 is omitted, since as we have found at studying the flexo ink containing carbon nanotubes the electric conductivity, therefore heat conductivity of the system consisting of heat paper H provided by heat sensitive layer 2 and flexo ink with multi-walled carbon nanotubes applied directly thereon changes as a function of relative humidity and temperature of ambient air.

Measuring the electric resistance of a measuring field 9 by means of a measuring element 13 depicted in FIG. 9 immediately before thermal printing, a relative humidity RH1 can be determined by a calibration curve previously recorded experimentally on electric conductivity, temperature and humidity of a system to be heat printed and consisting of a thermal paper H and flexographic ink system with carbon nanotubes, a curve being similar to that is shown in FIG. 2, but consisting indeed of much more measurement points. Experiments were performed with 4 wt % functionalized flexographic ink containing multi-walled carbon nanotubes and applied in a wet film thickness of 12 microns. Likewise, a correlation as shown in FIG. 3 of heat conductivity, temperature and relative environmental humidity of a system consisting of a topcoat ink layer scheme containing carbon nanotubes and thermal paper H was experimentally determined.

Consequently, by measuring, according to the invention, the electric resistance and temperature of a thermal paper H provided by a topcoat ink layer system containing carbon nanotubes to be heat printed by means of a preprinted measuring field 9 and a measuring element 13 immediately before thermal printing, its value of humidity RH1 according to the calibration curve shown in FIG. 2 is available as well.

If the moisture content is higher or lower than an RHM value equivalent to a maximum relating to the thermal conductivity of a given thermal paper provided by a flexo topcoat ink layer system containing carbon nanotubes, a relationship similar as shown in FIG. 3, humidity prevailing in direct surroundings of printing is increased or decreased so long as it reaches an optimal value RHM according to the function.

Subsequently, the thermal printing is performed by making the thermal printing head 6 to operate and transmitting thermal energy in the range T shown in FIG. 5 to the thermal paper H provided by a topcoat flexo ink layer system containing carbon nanotubes.

Increasing or decreasing the humidity in the close vicinity of thermal printing and transmitting thermal energy required to form the print 7 is implemented by a thermal printer apparatus according to the present invention.

FIG. 7 shows the thermal conductivity of a thermal paper H sample provided by flexographic covering paint scheme of layers containing carbon nanotubes and placed at an environment of 25° C./85% RH relative humidity as removed from exsiccator—as a function of time t, so that the sample was transferred at t=0 from a dry exsiccator of 0% relative humidity RH to a test chamber having 85% relative humidity RH. Accordingly, the vertical axis represents a percentage of thermal conductivity difference of the sample from the steady heat conduction coefficient belonging to 85% relative humidity RHM (see FIG. 3). In FIG. 7, one can observe that after a thermal paper H sample provided by a topcoat ink layer system containing carbon nanotubes kept in a dry exsiccator being moved to a place having a given relative humidity RH the thermal conductivity of this sample reaches a thermal conductivity of a sample kept in that place in balance in just a few seconds. This observation provides the basis of creating a microenvironment having really in situ controlled relative humidity RH by means of correct selection of a distance of the measuring field 9 placed on a measuring point and the printing head 6 and by establishing an optimal geometry of a paper H path and of air nozzles both described later.

Hence it follows that the electric conductivity, and as a consequence heat conductivity of the system can be finely controlled by adjusting overall humidity of a combined thermal paper H+flexographic topcoat ink layer system containing carbon nanotubes. Moreover, as the humidity of the sample material and the surrounding air are in dynamic equilibrium with each other, this type of control can be implemented in practice by precisely controlling the relative humidity of the air in the microenvironment of the printing operation carried out by a thermal printer 10 according to the present invention.

FIG. 8 is a schematic representation of a thermal printer 10 according to the invention. A reel 12 for storing and dispensing a thermal paper H provided by a topcoat ink layer system containing carbon nanotubes is arranged in house 11 of printer 10. Thermal paper H, while running from the reel 12 on transfer and counterpressure rollers G, passes along e.g. a pair of vacuum type measuring elements 13 containing silver-plated copper electrodes having a structure shown in FIG. 9, preferably suitable for measuring specific surface and volume resistivity according to the Hungarian standard MSZ EN 61340-2-3: 2001 (A) and having preferably a surface area of 10×10 mm and being spaced apart by 10 mm in this embodiment. On a thermal paper H a topcoat ink layer system containing carbon nanotubes are applied in advance by printing preferably scattered by distances equal to a spacing unit h, which form measuring fields 9 to be contacted with electrodes 14*a*,14*b* of a measuring element 13 in order to be measured an electric resistance between them. In developing electrodes 14*a*, 14*b* requirements of standard laboratory measurement according to EN 61340-2-3: 2001 (A) were taken into account. Preferably standard sized contacting means of electrodes 14*a*, 14*b* is made of a silver-plated copper block 15 having air ducts 16 formed thereinside and a silicone insulating edge 17 for hermetically closing a vacuum space 18 to be evacuated e.g. by a vacuum pump and connected to the surface of the copper block 15 by said air ducts 16.

A blower system 19 arranged in the thermal printing apparatus 10 controls the air temperature prevailing in the house 11. A photocell sensor 20 is for detecting spacing units h, such that it detects any signal M printed on the back side of the thermal paper H roll according to a correct position of measuring field 9 arranged on the other side, as shown in FIG. 10.

Reservoir 21 containing air of 0% relative humidity RH content is provided for absorbing moisture content in excess of RHM. An evaporative heating element 22 is for providing a moisture content difference being necessary to reach an adequate relative humidity RHM by evaporating water sprayed onto the heating element 22. Thermal printing takes place by operation of the printer head 6, and then thermal paper H tape leaves the house 11 by passing behind transparent e.g. plexiglass windows 24, 25. Owing to an adequate infrared-absorbing capacity of windows 23.24 thermally printed information protected by flexo topcoat layers cannot be read in seconds after printing either by an infrared camera.

A reservoir 23 of 100% relative humidity RH containing water is provided in the house 11 of the thermal printing apparatus 10, which may spray an amount of water determined by the control electronics, for example. 10 picoliter, onto the evaporative heating element 22 in order to provide further moisture content inside the housing 11 of the printer apparatus 10 if it is required, as determined by the control electronics. The 0% relative humidity RH reservoir 21, which consists preferably of a metal container provided by electric resistance heating, decreases the relative humidity RH of the air passing through it, so that the excess moisture content can be absorbed. In an alternative embodiment a closed metal container is arranged before the reservoir 21, in which a zeolite cartridge was placed, which is suitable for decreasing the absolute humidity of the air by adsorption (not shown). The zeolite may be a disposable cartridge, or automatically regenerated by the apparatus 10.

The blower system 19, not shown in Figures, is suitable for delivering air onto the thermal paper H before the printing head 6 through reservoirs 21, 23 by means of fans, solenoid valves and nozzles not shown but well known in the art, according to a target humidity RHM.

The measuring element 13 sensing electric resistance monitors the electric resistance of the measuring fields 9 permanently or cyclically as needed and the apparatus 10 controls the operation of reservoir 23, temperature of evaporative heating element 22 and the valves both of blower system 19 and reservoir 21 based on the measured values.

A thermal printing cycle begins with printing a print on a surface area of the heat sensitive layer 2 covered and uncovered by ink layer system, and then, in a fixed state of the thermal paper H, the shortest time period of which is 15 sec passing up to the next printing cycle, a measuring cycle takes place on the next measuring field 9 in a time of 1-4 sec. The series of measurements are evaluated by the electronics by means of an algorithm developed for this purpose and controls the temperature and humidity control devices of the apparatus 10.

While regulating in the practice the humidity RH in the interior of the housing 11 of thermal printer apparatus 10, the humidity-electric resistance correlation is exploited in both directions by controlling evaporating, absorbing, heating and cooling processes described above. The apparatus 10 measures of all time or as needed in specified cycles 9 the electric resistance of the measuring fields 9, on the basis of that measured value a calibrated controller counts the actual relative humidity RH1 prevailing inside the house 11 of the apparatus 10. This value is corrected by the apparatus 10 to an optimum value of relative humidity RHM predetermined individually for each thermal paper H by operating the blower system 19, the reservoir 21 containing air of 0% relative humidity RH, the evaporating heating element 22 and reservoir 23.

Therefore, the main advantage of the aqueous flexo topcoat ink layer system containing carbon nanotubes arranged on a heat sensitive carrier 1 heat printable by the apparatus 10 and method according to the invention against solution of the art is that on the one hand that the heat transmitting covering paint scheme has improved heat transmitting properties and it is removable without damaging the heat sensitive layer, but its heat conductivity and, therefore, the quality of a print to be formed thereunder are far better than that of removable topcoat ink layers belonging to the state of the art. On the other hand, by the use of the thermal printer and thermal printing process according to the invention the thermal conductivity of a topcoat ink system with improved thermal conductivity according to the present invention can be optimized directly during printing without the need of the coated carrier should have a pre-printing moisture content necessarily exceeding the optimum moisture content, immediately before printing. Therefore, the heat energy level required to form the print may be lower resulting in a reduced power consumption and thermal load of the printing head 6—since the resolution of the printer is determined by the size of heat developing resistors, the possibility of miniaturization of which is limited, but the size is inversely proportional to the physical resistance of the resistor against its thermal load that is its lifetime—and the thermal deformation of the topcoat layer system can be avoided as well.

The invention claimed is:

1. A heat sensitive carrier (1) provided with a heat sensitive layer (2) to be colored by applying heat and a removable aqueous flexo covering paint scheme of layers, characterized in that the paint scheme of layers comprising a coat of lacquer (3) containing 70% acrylate oligomer, 22% acrylate monomer, 5% photo-initiator and 3% silicone is-arranged on the heat sensitive layer (2); a disperse parting layer (4) containing 20% soot paste with 35% of soot, 25% aqueous acrylate emulsion, 6% calcined kaolin, 1% antifoam agent and spread improver, 3% rheological modifier and 45% water arranged on the coat of lacquer (3); and a topcoat paint layer (5) containing carbon nanotubes functionalized by hydroxyl, carbonyl and carboxy groups arranged on the disperse parting layer (4), and wherein measuring field (9) is printed with an ink containing carbon nanotubes directly onto the surface of the heat sensitive layer (2) of the heat sensitive carrier (1).

2. The heat sensitive carrier (1) according to claim 1, characterized in that the length of the carbon nanotubes arranged in the topcoat layer (5) is between 4-20 μm.

3. The heat sensitive carrier (1) according to claim 2, characterized in that the topcoat layer (5) is formed by 32% of an aluminum paste containing 70% Al, 3% nanotube paste, 60% aqueous acrylate emulsion, 1% combination of antifoam agent and spread improver, and 4% of water.

4. The heat sensitive carrier (1) according to claim 3, characterized in that the carbon nanotube paste consists of 5% hydrophilized carbon nanotubes having a length of 4-20 μm, 20% aqueous acrylate emulsion, and 2% combination of an antifoaming and a spread improver agent, 0.3% pH adjusting additive, 0.2% biocide additive, 3% isopropyl alcohol, and 69.5% of water.

5. A method for thermal printing of a heat sensitive carrier (1) provided with a heat sensitive layer (2) to be colored by applying heat and preprinted by a removable aqueous flexo covering paint scheme of layers including a topcoat paint layer (5) containing carbon nanotubes functionalized by hydroxyl, carbonyl and carboxy groups, the method comprising the steps of subjecting the heat-sensitive layer (2) of the carrier (1) to heat radiation generated by a thermal printing head (6) characterized in that before applying said thermal radiation, measuring field (9) being formed on the heat-sensitive layer (2) of the carrier (1); determining experimentally a function (Fr) between the electric resistance and temperature as well as relative humidity of environment of the flexo covering paint scheme of layers; then determining a value of relative humidity (RHM) belonging to a maximum of a function (Fs) between thermal conductivity and temperature (T1, T2, T3) as well as relative humidity of environment of the flexo covering paint scheme of layers; measuring electric resistance (R1) of the measuring field (9); determining relative humidity (RH1) of the measuring field (9) by using the value of the resistance (R1) and the function (Fr); and changing the value of relative humidity (RH1) into the value of relative humidity (RHM) in a space surrounding the carrier (1).

6. A method according to claim 5, characterized by forming a measuring field (9) on the heat-sensitive layer (2) of the carrier (1), consisting of a disperse parting layer (4) containing 20% soot paste with 35% of soot, 25% aqueous acrylate emulsion, 6% calcined kaolin, 1% combination of antifoam agent and spread improver, 3% rheological modifier and 45% water, and a topcoat paint layer (5) containing carbon nanotubes functionalized by hydroxyl, carbonyl and carboxy groups arranged on the disperse parting layer (4).

* * * * *